US011988046B1

(12) United States Patent
Borissov

(10) Patent No.: US 11,988,046 B1
(45) Date of Patent: May 21, 2024

(54) HYDROJETS ROTARY DRILL BIT

(71) Applicant: Anatoli Alimpievich Borissov, Sugarland, TX (US)

(72) Inventor: Anatoli Alimpievich Borissov, Sugarland, TX (US)

(73) Assignee: Cool Edge Bits, Houston, TX (US)

( * ) Notice: Subject to any disclaimer, the term of this patent is extended or adjusted under 35 U.S.C. 154(b) by 0 days.

(21) Appl. No.: 18/491,784

(22) Filed: Oct. 22, 2023

Related U.S. Application Data

(60) Provisional application No. 63/592,201, filed on Oct. 22, 2023.

(51) Int. Cl.

| | |
|---|---|
| ***E21B 10/61*** | (2006.01) |
| ***E21B 4/02*** | (2006.01) |
| ***E21B 10/60*** | (2006.01) |
| ***E21B 36/00*** | (2006.01) |

(52) U.S. Cl.
CPC ..... *E21B 10/61* (2013.01); *E21B 4/02* (2013.01); *E21B 10/602* (2013.01); *E21B 36/001* (2013.01)

(58) Field of Classification Search
CPC ..... E21B 10/61; E21B 10/602; E21B 36/001
See application file for complete search history.

(56) References Cited

U.S. PATENT DOCUMENTS

| | | | | |
|---|---|---|---|---|
| 3,190,376 A * | 6/1965 | Christensen | E21B 7/005 175/102 |
| 3,964,554 A * | 6/1976 | Ricks | E21B 36/00 175/359 |
| 4,246,977 A | 1/1981 | Allen | |
| 4,323,130 A | 4/1982 | Dennis | |
| 4,391,339 A | 7/1983 | Johnson, Jr. et al. | |
| 4,452,324 A | 6/1984 | Jurgens | |
| 4,460,053 A | 7/1984 | Jurgens | |
| 4,540,055 A | 9/1985 | Drummond et al. | |
| 4,540,056 A | 9/1985 | O'Hanlon | |
| 4,543,019 A * | 9/1985 | Shikata | B23B 51/0486 175/323 |
| 4,582,149 A | 4/1986 | Slaughter, Jr. | |
| 4,606,418 A | 8/1986 | Thompson | |
| 4,640,374 A | 2/1987 | Dennis | |
| 4,794,994 A * | 1/1989 | Deane | E21B 10/43 175/429 |
| 4,830,124 A | 5/1989 | Zijsling | |
| 4,989,680 A | 2/1991 | Deane et al. | |
| 5,230,389 A | 7/1993 | Besson | |
| 5,417,296 A | 5/1995 | Murdock | |

(Continued)

FOREIGN PATENT DOCUMENTS

CN 114645676 A * 6/2022

OTHER PUBLICATIONS

CN 114645676 (Year: 2022).*

*Primary Examiner* — Blake Michener
(74) *Attorney, Agent, or Firm* — PatentPC; Bao Tran

(57) ABSTRACT

A hydrojet rotary drill bit (10) is provided for drilling a hole in a subsurface formation. The bit body (12) includes a plurality of axially extending ribs (16*a, b, c, d, e,* and *f*) and a flow channel between adjacent ribs. A plurality of cutting elements are fixedly mounting on a respective one of the plurality of ribs. A plurality of flow nozzles (20*a, b, c, d, e,* and *f*) made on respective one of the plurality of ribs to direct fluid (mud) to a respective one of the plurality of cutting elements to clean and cool the cutting elements.

16 Claims, 6 Drawing Sheets

(56) References Cited

U.S. PATENT DOCUMENTS

| | | | | |
|---|---|---|---|---|
| 5,595,252 | A * | 1/1997 | O'Hanlon | E21B 10/46 175/57 |
| 5,699,868 | A | 12/1997 | Caraway et al. | |
| 6,253,864 | B1 | 7/2001 | Hall | |
| 6,474,423 | B2 | 1/2002 | Wood | |
| 6,581,702 | B2 | 6/2003 | Dickey | |
| 8,100,201 | B2 | 1/2012 | Borissov | |
| 2006/0124362 | A1* | 6/2006 | Kolle | B05B 3/003 175/67 |
| 2010/0018771 | A1* | 1/2010 | Borissov | E21B 10/60 175/57 |
| 2011/0297451 | A1* | 12/2011 | Cox | E21B 10/5673 175/428 |
| 2013/0075166 | A1* | 3/2013 | Cox | E21B 10/54 175/393 |
| 2023/0212944 | A1* | 7/2023 | Bhome | E21B 49/06 175/77 |

* cited by examiner

HYDROJETS ROTARY DRILL BIT

FIELD OF THE INVENTION

The present invention relates to a rotary drill bit.

BACKGROUND OF THE INVENTION

There are two types of drill bits: fixed cutters rotary drill bits and roller cones drill bits. Fixed cutters rotary drill bits are commonly used to drill in a formation by cutting the soil or rock. Drilling mud is used to control subsurface pressures, lubricate the drill bit, stabilize the well bore, and carry the cuttings to the surface. Mud is pumped from the surface through the hollow drill string, exits through nozzles in the drill bit, and returns to the surface through an annulus between the drill string and the interior wall of the hole.

As the drill bit grinds rocks into drill cuttings, these cuttings become entrained in the mudflow and are carried to the surface. Prior to returning the mud to the recirculating mud system, the solids are separated from the mud. The first step in separating the cuttings from the mud commonly involves circulating the mixture of mud and cuttings over shale shakers. The liquid mud passes through the shaker screens and is recirculated back to the mud tanks from which mud is withdrawn for pumping downhole. The vibratory action of the shakers moves the cuttings down the screen and off the end of the shakers, where they are collected and stored in a tank or pit for further treatment or management. Often two series of shale shakers are used. The first series (primary shakers) use coarse screens to remove only the larger cuttings. The second series (secondary shakers) use fine mesh screens to remove much smaller particles.

Additional mechanical processing is often used in the recirculating mud system processing is often used in the recirculating mud system to further remove fine solids because these particles tend to interfere with drilling performance. This separation equipment may include one or more of three types: 1) hydrocyclone-type desalters and desanders, 2) mud cleaners (hydrocyclone discharging on a fine screened shaker), and 3) rotary bowl decanting centrifuges. The separated fine solids are typically combined with the larger drill cuttings removed by the shale shakers.

Rate of penetration (ROP) of the drill bit is a major characteristic for wells, and often a critical cost issue for deep wells. Low ROP in the order of 3-5 feet per hour is commonly the result of the high compression strength of formations encountered at the greater depths, and the ineffectiveness of the cutting bit. Another important characteristic is the number of trips per well, which deal with the number of drill bits used in the drilling well.

Subterranean drill bits can be used in many different applications, such as oil and gas exploration, mining, construction, and geothermal.

A roller cones drill bit uses steel teeth or tungsten carbide inserts mounted with one, two, or three moving rollers. Tricone bits with hardened inserts are used for drilling hard formations at both shallower depths and deeper depths. However, at greater depths it is more difficult to recognize when a tricone bits bearings have failed, a situation that can occur with greater frequency when greater weight is applied to the bit in a deep well. This can lead to more frequent failures, lost cones, more frequent trips, higher costs, and lower overall rates of penetration.

Fixed cutters cutter bit does not use any moving cutting mechanism. Fixed cutter bits with polycrystalline diamond compact (PDC) cutters employ synthetic polycrystalline diamonds bonded to a tungsten-carbide stud or blade. PDC bits typically drill several times faster than tricone bits, particularly in softer formations, and PDC bit life has increased dramatically over the past 20 years. PDC bits nevertheless have their own set of problems in hard formations. For example, "bit whirl" is a problem that occurs when a PDC bit's center of rotation shifts away from its geometric center, producing a non-cylindrical hole. This can result from an unbalanced condition brought on by irregularities in the frictional forces between the rock and the bit. PDC bits are also susceptible to "stick slip" problems where the bit hangs up momentarily, allowing its rotation to briefly stop, and then slips free to rotate at a high speed. While PDC cutters are good at shearing rock, they are susceptible to damage from sharp impacts that lead to problems in hard rocks, resulting in reduced bit life and lower overall rates of penetration. PDC bit designs frequently include features that attempt to address these problems, namely, force balancing, spiraled or asymmetric cutter layouts, gauge rings, and hybrid cutter designs. Nevertheless, PDC bits frequently have significant shortcomings, particularly when drilling in extreme environments.

In a conventional drill bit, the fluid (mud) flows from one or several nozzles for clearing and cooling the cutters. The mud jet is commonly directed straight from the nozzle to the base of drilling bore (dome). Such flow of the mud causes numerous disadvantages. First, the jet entrains the drill cuttings or solids, and brings them to the bottom of borehole. Then drill cuttings go back up to passing the drill bit cutters, and they erode the bit's surface and cutters edges. Another disadvantage is that heat is not appropriately transferred from the bit's cutter to the mud, due to lower speed of the mud flow through the debris slots in the bit. This causes a large heat stress on the cutters thus reducing their rigidity, which in turn reduces the rate of penetration and the operating hours for the drill bit.

U.S. Pat. No. 6,142,248 to Thigpen et al. discloses a method to reduce nozzle erosion using a nozzle which supplies the mud in the laminar flow regime. An enhanced hydraulic design (Mudpick II) plays a key role in the roller cone drill bit performance. The mud stream is directed first to clean the cutters and then it sweeps under a cutter at the point of formation contact for efficient chip removal. The jet path from the nozzle expands and meets the teeth on a roller cone, which commonly are not in contact with the formation. The jet dissipates and loses hydraulic energy and does not provide the desired efficiency.

U.S. Pat. No. 8,100,201 to Borissov disclosed a method to improve the heat rejection from the cutters and reduce their temperature to increase the rigidity of the cutters. The method works very well. However, the hydraulic path in this invention does not use all advantages of the drill bit design and is not the optimal.

The disadvantages of the prior art are overcome by the present invention, and a new rotary drill bit and method of operating a drill bit are hereinafter disclosed.

SUMMARY OF THE INVENTION

In one aspect, a rotary drill bit for drilling a hole in a subsurface formation includes a bit body having a leading cutting face and outer peripheral edges, the bit body including a plurality of radially extending ribs with a flow channel between adjacent ribs, the bit body further including a bit body flow path radially inward of the peripheral edges; a plurality of cutting elements each fixedly mounted on a respective one of the plurality of radially extending ribs; a plurality of flow nozzles on each rib's manifold in fluid communication with the bit body flow path for creation and directing high speed fluid jets directed to the cutter's edge from manifold to a respective one of the plurality of cutting elements to clean and cool the cutting element; and manifolds for receiving a fluid flow from the bit body flow path located inside of each rib, wherein the fluid flow is outputting tangentially to the circumference of bit body through a plurality of conical flow nozzles to the respective plurality of cutting elements mounted on a respective neighboring rib and wherein the rib's manifold positioning each of the plurality nozzles on an opposite side of the cutters (backside to the cutters) to create the torque in the same direction as applied to the drill bit.

In another aspect, a method of drilling a hole in a subsurface formation includes providing a bit body having a plurality of radially extending ribs with a flow channel between adjacent ribs, the bit body further including a bit body flow path radially inward of its peripheral edges; fixedly mounting a plurality of cutting elements on a respective one of the plurality of radially extending ribs; providing a rib's manifold for receiving fluid flow from the bit body flow path and outputting fluid through a plurality of conical profile's flow nozzles to a respective plurality of cutting elements mounted on a following neighboring rib, the rib's manifold positioning each of the plurality of nozzles on the back side of the rib's and facing to the cutters on the following rib; and providing a plurality of flow nozzles each in fluid communication with the bit body flow path for directing fluid to the rib's manifold and then to respective one of the plurality of cutting elements.

a rotary drill bit is provided for drilling a hole in a subsurface formation. The drill bit includes a bit body having a leading cutting face and outer peripheral edges. The bit body also includes a plurality of radially extending ribs with a flow channel (slots for cuttings removal) between adjacent ribs and includes a bit body flow path radially inward of the peripheral edges. A plurality of cutting elements are each fixedly mounted on a respective one of the plurality of radially extending ribs. A plurality of flow nozzles are made on each rib with special conical interior profile of the nozzle 20, FIG. 4. Each flow nozzle is in fluid communication with a bit body flow path to direct fluid, shown by arrows on FIG. 4, to a respective one of the plurality of cutting elements 18 on FIG. 1, to clean and cool the cutting element.

These and further features and advantages of the present invention will become apparent from the following detailed description, wherein reference is made to the figures in the accompanying drawings.

a. DETAILED DESCRIPTION OF PREFERRED EMBODIMENTS

The present invention relates to improvements in drill bits which result in improved rate of penetration (ROP), increased working hours, and reduced requirements for the cutters. The present invention provides a significantly improved hydraulic system which manages the fresh fluid high speed jet flow to each tooth of the drill bit. The rotary drill bit includes a plurality of cutting elements each mounted on a respective one of a plurality of radially extending ribs, and a plurality of flow nozzles, made on respective one of the plurality of ribs, for directing fluid jets to a respective one of the cutting elements.

Figure 1:
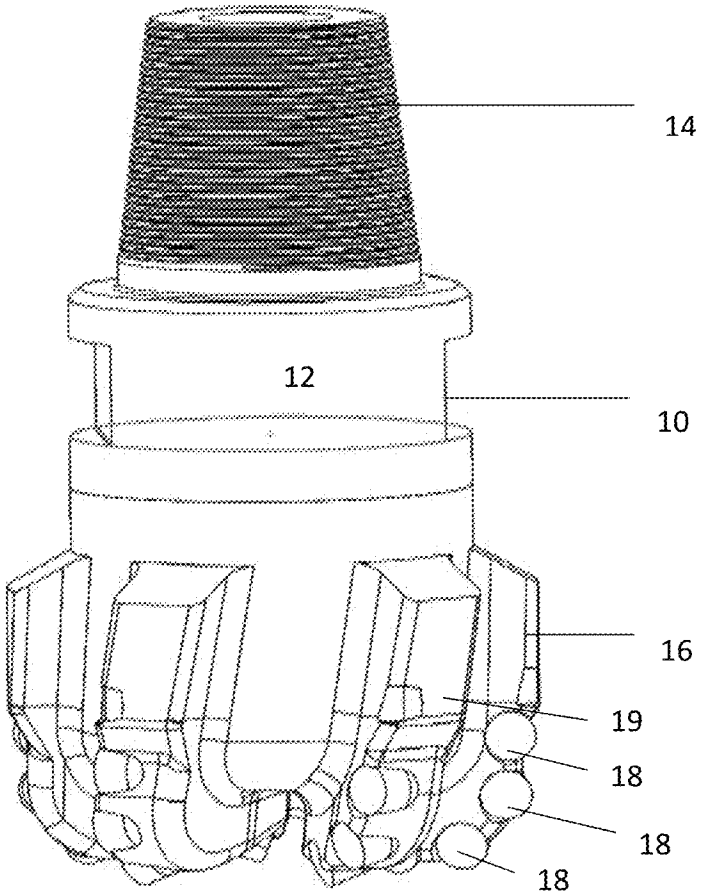
FIG. 1 illustrates a side view of one embodiment of a rotary bit according to the present invention.
Figure 2:
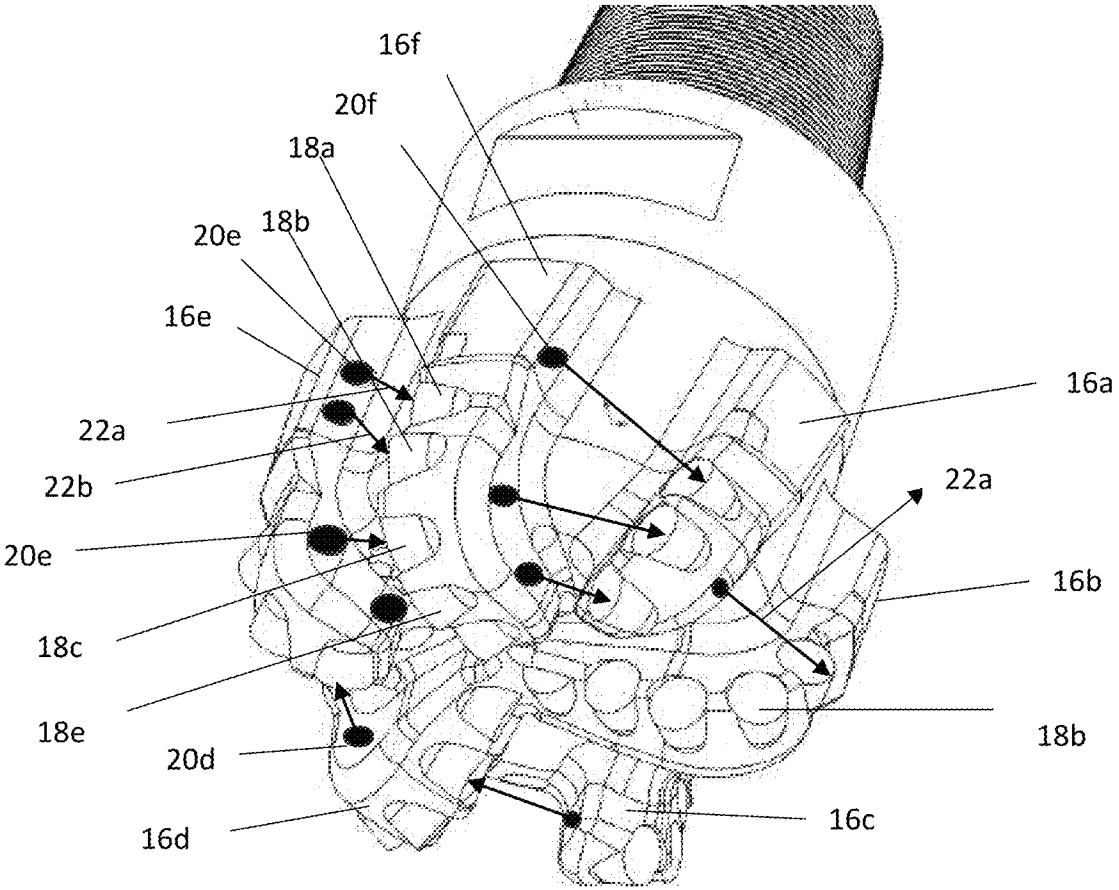
FIG. 2 is an isometric view of the drill bit shown in FIG. 1.

The operation of this downhole drill bit results in reduced thermal stresses at the cutter by an individual jet cooling each tooth, improved cleaning capability by supplying fresh fluid to the cutter, and reduced erosion of the cutters. Referring now to FIG. 1, one embodiment of an improved rotary drill bit 10 is illustrated, comprising a bit body 12 with upper box threads 14 for interconnection with a drill pipe or other tubular. Those skilled in the art will appreciate that box threads 29 on FIG. 3 may be provided on the bit body rather than the pin threads. As shown in FIGS. 1 and 2, the drill bit includes six circumferentially spaced blades or ribs 16*a*, 16*b*, 16*c*, 16*d*, 16*e*, and 16*f*. Each of these ribs supports a plurality of cutting elements, each fixed to a respective rib, such as cutting elements 18 shown in FIGS. 1 and 2. Each of the ribs or blades may have a generally curved trapezoidal configuration, although other configurations may be provided for the radially extending ribs. The rib 16 may be provided with gauge cutters 19, which in many applications do not include PDC cutting elements. Still referring to FIGS. 1 and 2, the drill bit includes a plurality of nozzles 20*a*, 20*b*, 20*c*, 20*d*, 20*e* and 20*f*, at each rib 16 comprising a plurality of discharge ports for jets 20*a*-20*f*, providing the high speed jets, shown by arrows, to the respective cutters 18.

Figure 3:
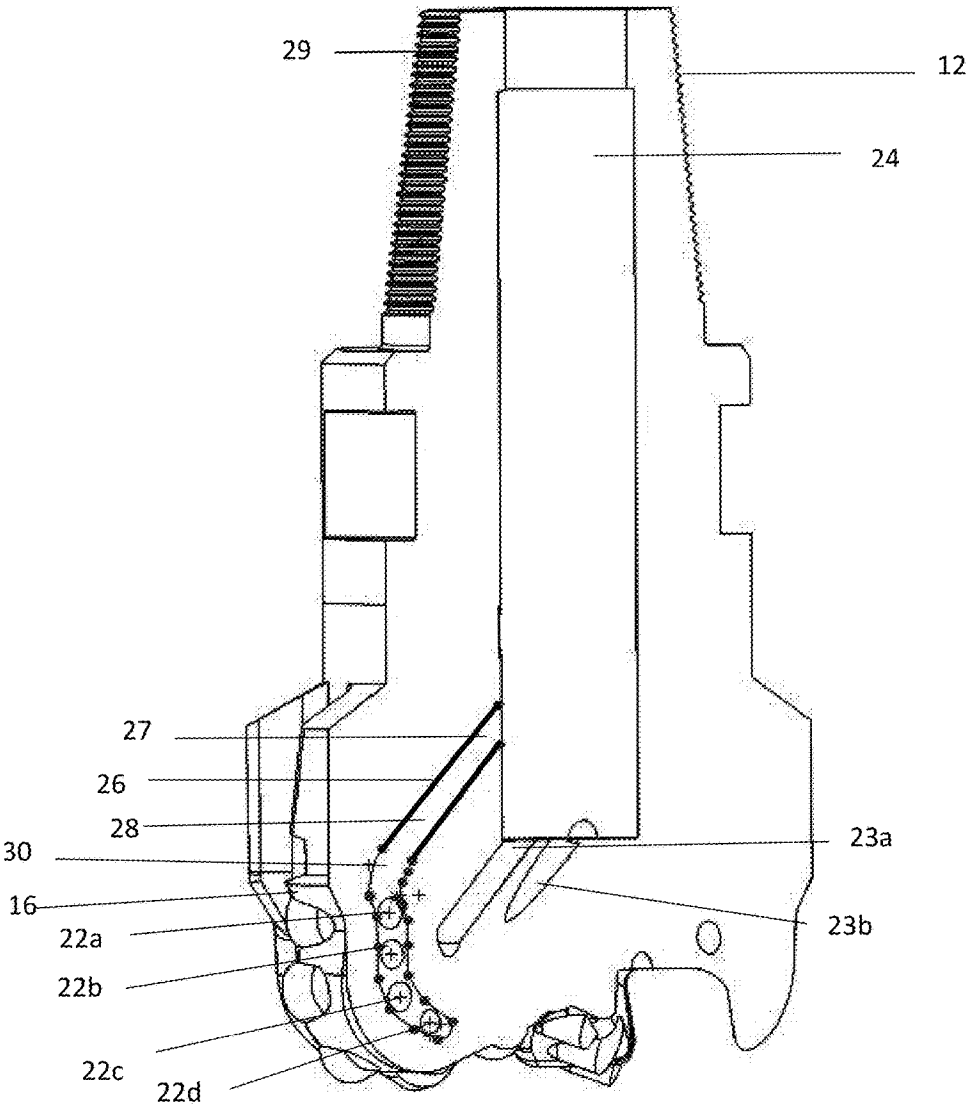
FIG. 3 is a cross-sectional view taken along lines A-A in FIG. 4.

Subsequently, each of the plurality of jets is beneficially directed toward a respective cutter to provide increased cooling and cleaning for a cutting element. A jet may be a profiled by using e.g., conical, converging hole through a wall of the rib and into the interior fluid manifold of the bit, or a desired size jet as an insert may be secured within a larger receiving hole in the rib. Each jet outputs tangentially relative to the circumferential of the drill bit body, at radial distance (lever) from the center of bit. In such arrangement the jets create torque, additional to the main torque for whole drill string. In this case drill bit works as the hydraulic motor and could provide essential saving of energy, fuel and reduce emission of carbon monoxide emanating from the main engines at the drill rig. Referring now to FIG. 3, bit body 12 includes a central flow path 24 therein for supplying fluid to the cutters. For this embodiment, manifold 26 is manufactured in each rib, and a flow line 28 transmits drilling fluid from the flow path 24 to the interior of the manifold 26. The manifold 26 in turn includes a flow chamber 30 therein, with a plurality of discharge ports 20 discharging fluid jets 22*a*-22*e* from the chamber 30 to a respective cutting element 18*a*-18*e*. FIG. 2 illustrates this feature in greater detail, with jet 22*a* being directed to cutter 18*a*, jet 22*b* being directed to cutter 18*b*, jet 22*c* being directed to cutter 18*c*, and jet22*e* being directed to cutter 18*e*. Jets are shown by arrows.

Those skilled in the art should appreciate that the drill bit includes a plurality of cutters on each rib, and a jet e.g., 22*a*-22*e* from rib, 16*d* is positioned for directing drilling high speed fluid jets to a respective one of the plurality of cutters on the neighboring rib 16*f*. In one example, a rib may contain seven cutters and the manifold associated with that rib may contain seven jets, with each jet corresponding to a respective cutter. In other embodiments, however, more cutters than jets may be provided, so that one or more cutters may not have a jet specifically directed to that cutter. In yet other embodiments, a jet may be provided for each of the cutters on a rib; and referring to FIG. 5 in another embodiment jets 22 from the bottom surface of the bit body, may be provided for removing debris in a desired manner and can be directed to a specific cutter, as well. A plurality of cutters are thus provided on each rib, and preferably four or more cutters are provided on each rib. Each of the plurality of cutters provided on a rib is provided with a respective jet, although additional cutters may not have jets, and additional jets may not have a corresponding cutter. In most applications, however, at least 3 or 4 cutters each supported on a rib will be supplied with fluid from a jet directed to that cutter.

Figure 4:
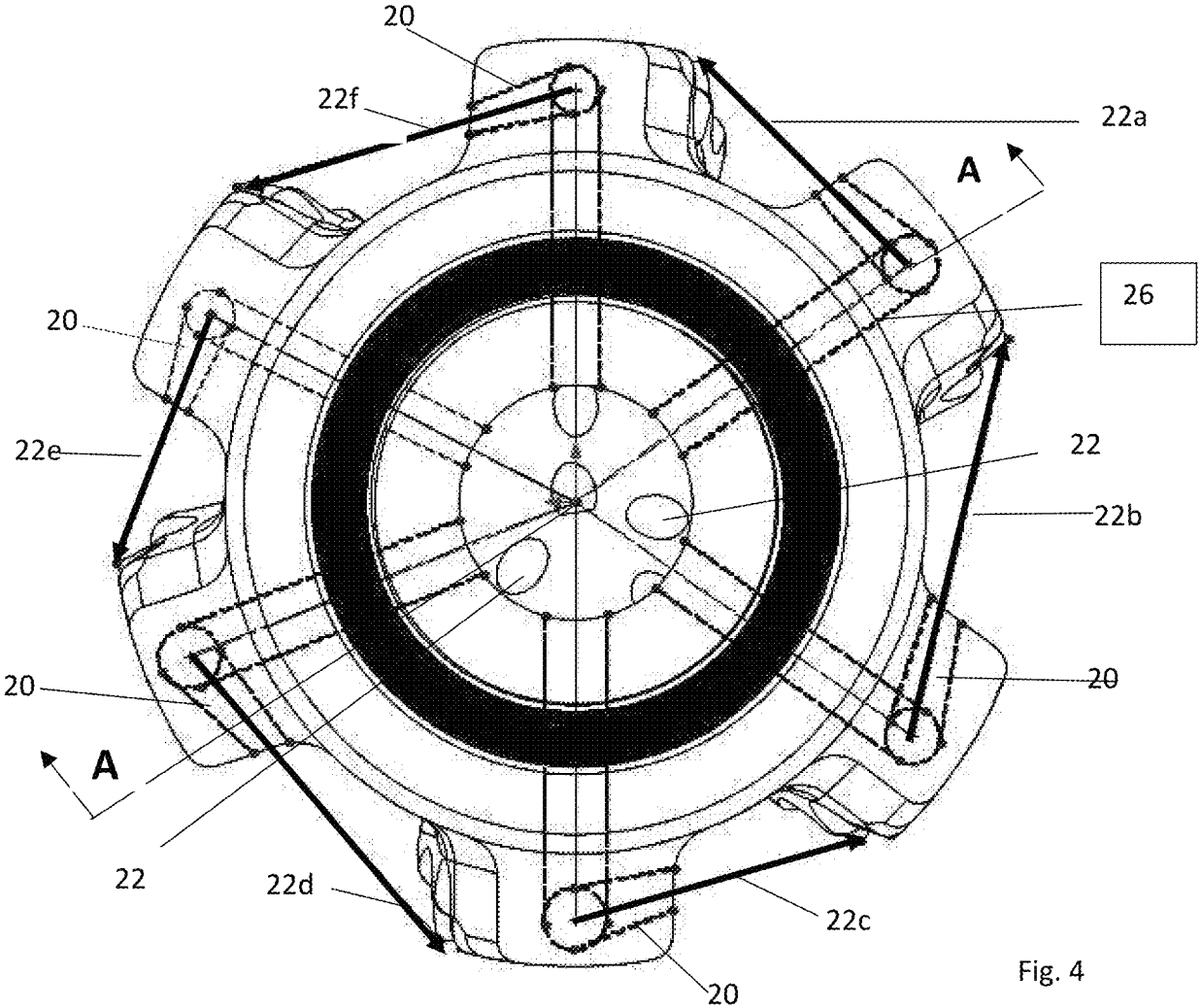
FIG. 4 is a top view of the bit shown in FIG. 1.
Figure 5:
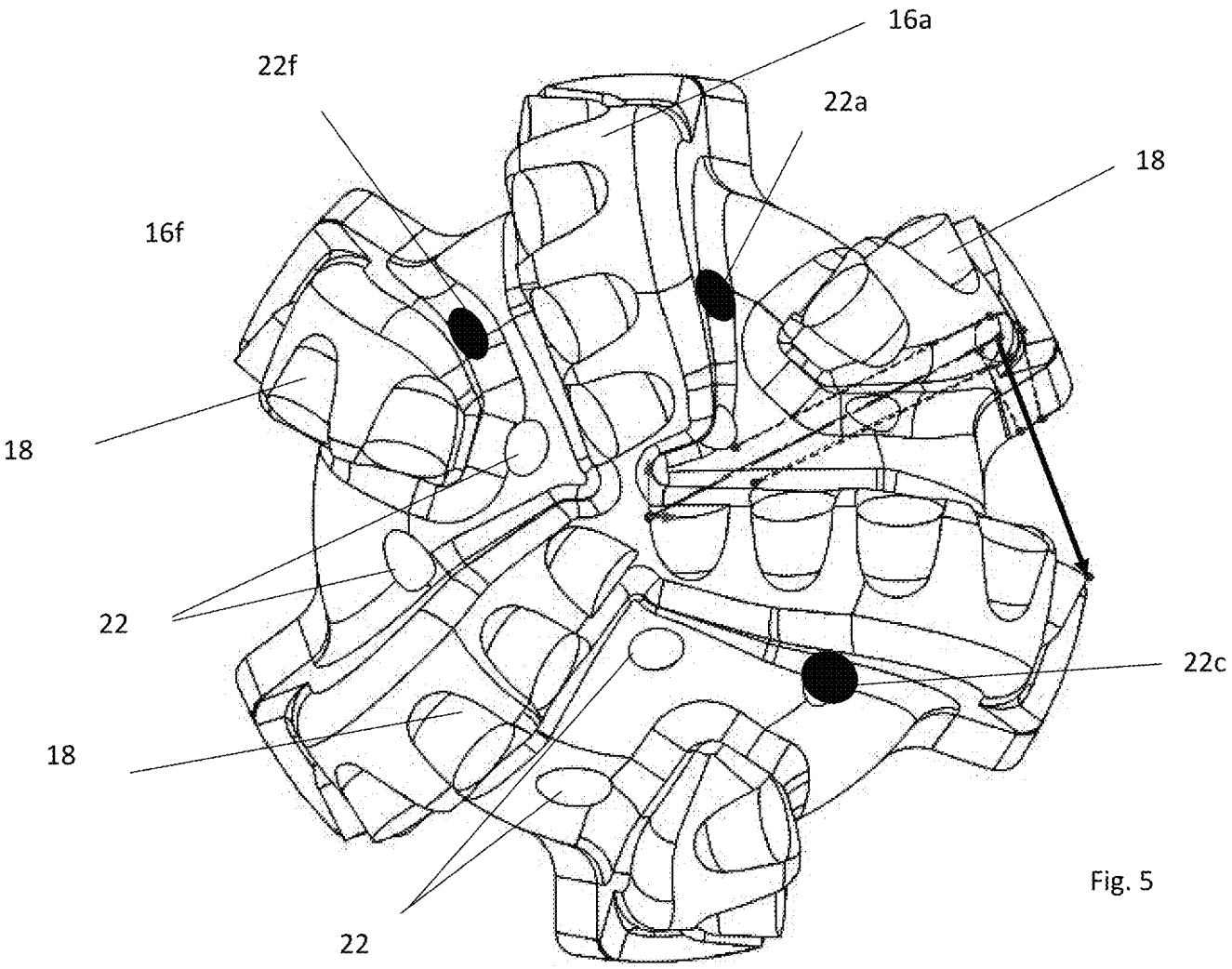
FIG. 5 is a bottom view of the drill bit shown on FIG. 1.

For the embodiment as shown in FIG. 2 and FIG. 5, each of the jets 22*a*-22*e* provided on ribs manifold 26 are spaced approximately a uniform distance from the each other. This provides substantially equal fluid velocity from each jet to a respective cutter. For the embodiment as shown in FIGS. 2-5, a manifold 26 is similarly provided for each rib. FIG. 5 discloses a drill bit 10 which is similar to the drill bit shown in FIG. 1, except that the jets in the ribs manifold 16*a-e* are not spaced a uniform distance from the cutters 18*a-e* fixed to the rib 16*f*, and instead the spacing between a jet and a respective cutter increases as a function of the radially outward distance of the cutters and the jets from the centerline of the bit.

As shown in FIG. 5, this allows the ribs manifold to be spaced substantially equidistantly, which may provide for better lubrication and flow of drilling fluids and solids into the annulus above the bit. The spacing between a jet and a respective cutter increases as the cutter spacing from the centerline of the bit increases, thereby increasing the washing area adjacent the cutters and improving removal of debris. FIG. 2 shows a central jet path 22*a* from the central axis of the discharge port 20*e* for each jet 22*a* to the primary cutting surface 18*a* on the face of the bit. The correlation between a jet and the respective cutter does not appear to be linear for the previous embodiment since the cross-section is taken through the ribs manifold, which is not parallel to the face of the cutters on a rib. Each jet central jet path 22*a*, 22*b*, 22*c*, 22*d*, 22*e*, 22*f* is illustrated in FIG. 2. Manifold 26 as shown in FIG. 3 includes an inlet port 27 for directing fluids into the interior of the rib's manifold cavity 30. The manifold itself as shown in FIG. 3 may be manufactured in various manners in the bit body, e.g., with 3D printing drill head technics and/or drilling and welding. Another way to distinguish the jets in a drill bit of this invention from the prior art relates to the high percentage of momentum of fluid from a specific jet which directly engages a primary cutting edge and surface of a respective cutter. According to this invention, a high percentage of the high fluid momentum from a jet is focused and directed to a respective cutter which is highly beneficial to desired cooling and cleaning of a cutting element. The spacing between a jet and the respective cutter also is preferably less than 11 times the mean diameter of the jet discharge, and in many cases is 10 times or less the mean diameter of the jet at discharge. The drill bit 10 as shown in FIG. 1 is substantially similar to the FIG. 5 embodiment, with each rib's manifold 26 being spaced approximately equally according to the spacing between ribs. As seen more clearly in FIG. 3, cavity 26 in the rib manifold is formed directly in the rib body 16*a-e*. The rib manifold includes a plurality of jets 22*a-e* each for directing fluid to a particular cutter 18*a-e*, as previously discussed. The flow path 28 in the manifold body supplies fluid from the central cavity 24 to the interior cavity in the manifold.

FIG. 2 illustrates in further detail that the rib manifold can be made in the rib, which is manufactured separately from the drill bit head and then can be welded to the bit head body. Each of the jets 22*a-e* has fluid jet flow directed to a particular cutter, 18*a-e* as discussed for the prior embodiment. This built-in design may also be used for the manifold positioned as shown in FIG. 1-2. FIG. 3 is a cross-sectional view of yet another embodiment of a drill bit body 12 with a central flow path 24 therein, and a plurality of cutters 18 each affixed to a respective one of a plurality of circumferentially spaced ribs, as discussed above. This embodiment does utilize a rib manifold, and a plurality of flow channels 28 each connecting the central flow path 24 to a respective jet, which in turn directs cooling fluid jet to a respective cutter 18. A plurality of cutters are conventionally provided on each rib, and FIG. 2 depicts a flow line 22*a* for each of the plurality of cutters, so that the six cutters as shown in FIG. 2 are each provided with a respective flow line 28 emanating from the central flow path 24. FIG. 2-4 shows in greater detail each of the flow paths 28 which has a discharge jet 22*a* at the discharge end 20*e* thereof for directing a jet to a respective one of the cutters. The flow paths 28 may be provided in the bit body or may be provided in the whole rib insert separate from the head and fixed to the bit body, so that the discharge ports are spaced in the rib supporting a respective cutter. In the event that the drill bit was to become partially plugged, the drilling operator may lift the drill bit off the drilling surface and increase fluid pressure in the annulus so that fluid backwashes into the drill pipe, thereby flushing the flow paths and jets with fluid.

Figure 6:
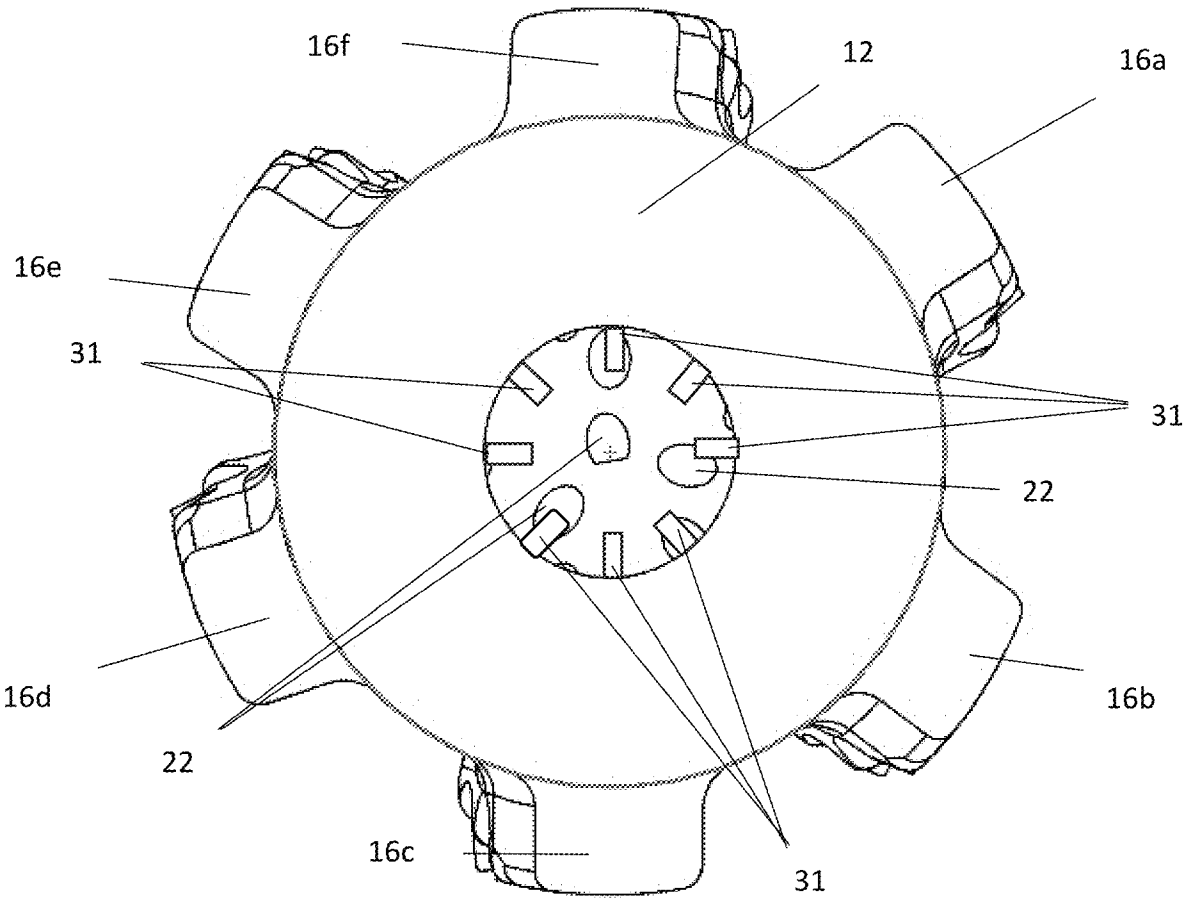
FIG. 6 is a top view of the drill bit's head with the interior fins and channels.

In another embodiment, referring FIG. 6, shows the internal cooling channels 22 and fins 31 in the drill bit head. The fins length propagates from the beginning of the bit head to the bottom of internal surface of the fluid channel 24. The cooling channels between the fins 31 have a rectangular profile with the thin fins and a wide base between the fins. The ratio of channel base, size between adjusting fins, to the fin thickness is in the range from 3 to 7. And the ratio of the fin's height to the channel base size is in between 2 and 3. The fin increases the heat transfer area and increases the heat rejection from the drill bit metal to fluid up to 100%. The fin's channels can be helical. This embodiment is very important for drilling a deep well where the temperature of the formation is high.

A method of drilling a hole in accordance with the present invention includes providing a bit body with a plurality of cutting elements each fixed to a respective one of a plurality of radially extending ribs, as discussed above. The method includes directing fluid from the bit body flow path to a plurality of flow nozzles each of them is forming high speed jet for directing this fluid jet to a respective one of a plurality of cutting elements to clean and cool the cutting elements. A rib could be made separately with the rib's fluid manifold and then fixed to the bit body. The rib manifold will provide fluid flow from a bit body flow path and outputting fluid through the plurality of flow nozzles. The bit body may include a plurality of flow path as 23*a* and 23*b* on FIGS. 4 and 22 on FIG. 6, each extending from the bit body surface, not only from the ribs, to a respective one of the plurality of cutters.

Other features of the method of the invention will become apparent from the foregoing description. The centerlines 22*b* on FIG. 4 of fluid flow from each nozzle is within 15° of a line passing through a central axis of the nozzle discharge port 20 and a primary cutting surface on a respective cutting element, and in many applications this jet centerline is within 10° of a line passing through the nozzle central discharge port and a primary cutting surface, particularly when the jet discharge port is generally circular rather than being elliptical or slot-shaped. As discussed above, the drill bit of the present invention includes a plurality of circumferentially spaced ribs, and each rib has fixedly mounted thereon a plurality of cutters. Larger diameter bits conventionally have more cutters, and also have a larger central flow path through the bit. According to the present invention, the mean diameter of the discharge port from each nozzle or jet is from about 3 mm to about 10 mm. In many applications, the mean distance of the discharge port will be from 3 mm to 8 mm. The exit hole diameter may increase for jets spaced radially outward from the bit centerline, particularly if the spacing between the jet and a respective cutter increases with this increased spacing. Each nozzle conventionally may have a circular discharge opening, but other configurations for an opening could be provided. In either event, the mean diameter of the opening is relatively small compared to prior art bits, since a discharge nozzle is preferably provided for cooling and cleaning one cutter, rather than a plurality of cutters. The use of multiple high speed fluid jets each directed to a respective cutter on the drill bit provides many benefits, such as improving the cleaning and scouring action, helping to remove the chip characteristics, and a better environment for the cutter and formation contact, which reduces the tooth wear, due to lower temperature of the cutter edge, because of the high speed jet provides higher heat rejection from the cutter edge, lubricates the teeth, provides uniform hydraulic balance for the drill bit, and reduces the "whirl" effect by providing more uniform cooling of the cutters and a cutting surface more uniformly affected by each of the plurality of cutters. The jets in current drill bit invention, provide the maximum cooling of an individual tooth, reducing the temperature of the cutter tip, and improving rigidity characteristics. These improvements increase the ROP provide longer bit life and allow for drilling longer intervals with no loss in ROP. A significant advantage of this invention is the reduction of erosion of the cutters as result of a substantial heat stress reduction and the reduction of the entrained drill cuttings in the mud moving past cutters at the point of formation contact by a jet, each achieved by supplying fresh fluid to each cutter. Another advantage provided by this invention is the reduction of the cutter's edge temperature due to reduction of heat stress on the cutters. In a conventional drill bit, mud first flows to the dome and on the return goes through the junk slots, which have a relatively large area. The mud velocity became thus small and consequently the coefficient of heat transfer is small compared with the present invention.

Another advantage of this invention is that during the cutting process, each jet helps to break the chips into smaller parts by applying hydraulic energy directly to the contact place between the primary cutting surface of a cutter and the formation. Better cleaning, cooling and lubrication of each individual cutter increases the rate of penetration and the operating hours for the drill bit. All advantages described above allow to use one drill bit to make the bore in one pass. Also allow us to reuse the same drill bit for multiple drilling.

The innovative design of the drill bit incorporates several distinct elements, which come together to enable highly efficient and effective drilling operations. This drilling bit comprises a bit body with a leading cutting face and outer peripheral edges. This bit body is specialized by the inclusion of numerous radially extending ribs, which in configuration leave ample space for a flow channel between each set of adjacent ribs. These structures consolidate to form a unique bit body flow path which sits radially inward of the peripheral edges, significantly enhancing the performance of the drilling bit.

The distinct characteristic of this rotary drill bit is the strategic mounting of a plurality of cutting elements. Each of the cutting elements is rigidly mounted on a respective one of the radially extending ribs. These cutting elements form the active operational feature of the drilling bit, allowing for the formation of holes in various substrates of varying hardness and consistency.

The structure of this rotary drill bit includes a plurality of flow nozzles located on each rib's manifold. These nozzles are in fluid communication with the bit body flow path and their strategic positioning and operation play a key role in maintaining the sharpness and overall performance of the cutting elements. The nozzles function to create and direct high speed fluid jets, specifically aimed towards the cutter's edge.

One function of these fluid jets is to clean and cool the cutting elements. Without this feature, the cutting elements could quickly become clogged with debris and reach high temperatures that would compromise the integrity of the bit. The fluid jets effectively wash away the debris and maintain a manageable temperature at the cutting edge, significantly extending the operational life of the drilling bit.

Further enhancing the flexibility and performance of the rotary drill bit is the provision of manifolds for receiving a fluid flow from the bit body flow path. These are positioned inside of each rib, designed in such a way that the fluid flow emanates tangentially to the circumference of the bit body.

Integration of the conical flow nozzles with discernible structures such as the plurality of cutting elements mounted on a respective neighboring rib is a unique mechanism. It prioritizes the tangential fluid flow from the rib manifolds, channeling it towards each cutting element to maximize cooling effect and debris removal, thus optimizing drilling efficiency.

Finally, the positioning of each manifold and the plurality of nozzles on each rib on an opposite side of the cutters (backside to the cutters) adds a dynamic aspect to the functionality of the rotary drill bit. This design element creates torque in the same direction as applied to the drill bit, thus enhancing the bit's drilling speed and overall performance. This optimal combination of elements makes this rotary drill bit an effective tool in a wide range of drilling scenarios.

One embodiment of the drill bit includes a body assembly having a threaded section for connection to a drill string, and includes a plurality of cutter carrying ribs extending radially from the body assembly, each cutter carrying rib extending axially and radially and having cutting elements disposed thereon. It is known in the art to use drilling fluid (also referred to as drilling mud) for both cooling and lubrication purposes as well as for assisting with the removal of cut material from the borehole.

Preferably, one or more nozzles are positioned on a rib opposite side of the cutters. This specific placement allows for a radial distance from the rotation center of the drill bit which is key to creating a lever and increasing the torque of the drill bit. These nozzles are purposed to direct jets of drilling mud tangentially relative to the body assembly. The power of the hydrojets thus provides tangential momentum to the drill bit, greatly enhancing its power and effectiveness. Essentially, the drilling fluid is used to forcefully create a high-speed jet that provides a mechanical advantage to the drill bit, optimizing rotation speed and reducing the frequency of bit stalls significantly.

The system further improves drilling efficiency by allowing improved flow of drilling mud to the borehole face, while simultaneously reducing the likelihood of bit balling, wherein cuttings accumulate at the face of the bit and hinder drilling operations. Furthermore, the radial placement of the nozzles provides a balanced effect on the drill bit, ensuring maintenance of balance and stability during rotation. This unique positioning of the nozzles also allows for effective cooling and cleaning of cutters, enabling optimum efficiency of drilling operations. It facilitates effective control over drill bit torque while maintaining high speed, leading to materially reduced drilling time and therefore reducing costs significantly. The proposed drill bit invention hence presents an innovative and much-needed solution for efficient and effective drilling in subsurface formations.

The rotary drill bit features one or more nozzles that provide a unique hydro-motor feature, generating torque momentum through the utilization of hydrojets. The primary purpose of this added feature is to optimize and augment the drill bit's efficiency and longevity in challenging drilling conditions. In the preferred embodiment, the one or more nozzles are strategically located on the rotary drill bit, exerting high-pressure fluid jets-hydrojets-onto the rock surface being drilled. The kinetic power of the exiting fluid results in torque, thereby creating mechanical advantage that is transferred to the rotary motion of the drill bit. This particular operational principle of transforming hydraulic energy into mechanical energy significantly enhances the overall drilling speed, reduces wear on the drill bit, and thus prolongs its service life.

The hydro-motor feature in this rotary drill bit is an innovative solution to common drilling problems, such as high wear and slowness, encountered in harsh drilling environments. Its integration into the drill bit design enables efficient utilization of the downhole hydraulic power made available during the drilling process. It can be advantageously applied across a variety of drilling operations, including mining and exploratory drilling. The drill bit system offers immense potential in enhancing the efficacy of drilling operations, demonstrating a significant improvement over conventional drill bits. Furthermore, the hydro-motorized drill bit is designed to be sturdy, easy to use, maintain, and offers a greater degree of control over drilling operations.

The drill bit system provides one or more nozzles with a specially designed converging profile. This innovative feature is designed to enhance the performance and efficiency of drilling operations, particularly those involving the use of drilling mud. The converging profile of the nozzles allows for an increase in the flow momentum and discharge rate of the drilling mud, facilitating more efficient rock cutting, bit cleaning, and chip removal.

The converging profile of the nozzles works by narrowing the path for the drilling mud, thereby maximizing the speed, pressure, and carrying capacity of the flow. As the drilling mud is forced through these narrowed channels, it increases in velocity, thereby gaining momentum necessary for better rock cutting and removal of cuttings from the drill bit. This design further improves the flow-through capacity of the bit, simultaneously advancing the cleaning and cooling function of the drill bit during operation.

The rotary drill bit provides distinct advantages compared to traditional designs. The introduction of the converging profile nozzle design results in a much more dynamic and efficient flow of drilling mud. This leads to several improved operational benefits, such as enhanced drilling speed, reduction in drill bit wear and, thus, increased lifespan of the drill bit, and improved overall drilling performance. The specialized profile allows the bit to handle higher flow rates of drilling mud, resulting in more efficient drilling processes that help to reduce costs, increase operational efficiency, and ultimately improve the extraction of resources.

The system offers a significant technological leap by incorporating a plurality of cutting elements, each meticulously mounted on a respective blade poised to provide exemplary drilling performance. These elements comprise of face cutting elements and side cutting elements, synergistically working together to deliver an exceptional cutting process to the user. The face cutting elements are designed to define a leading cutting face placed substantially perpendicular to a bit centerline. This scientific construction allows for precision in drilling, ensuring that the user can make burrow holes at a specific target location in the earth formation with the highest accuracy. This ingenious aspect of the design enables the face cutting elements to break apart the rock or other subterraneous formations effectively while maintaining the structural integrity of the drill bit even under high-pressure scenarios.

Adjacent to the leading cutting face, the novel rotary drill bit further comprises side cutting elements located adjacent to the outer peripheral edges of the bit body. These side cutting elements have a dual purpose. Firstly, they assist in cutting the lateral margins of the hole, contributing to the overall drilling performance. Secondly, they prevent excessive wear and tear on the external circumference of the bit during use. This design feature thereby supports a longer-lasting drill bit, possibly reducing the overall operational cost of the borehole drilling project. Each of these elements cohesively aids in the primary function of the rotary drill bit, ensuring an optimal, reliable, and efficient operation.

In one embodiment, the rotary drill bit features manifolds discretely embedded within the plurality of radially extending ribs. This structure aims at implementing an enhanced distribution of drilling fluids, increased efficient rock fragmentation and significant reduction in drill bit wear and tear.

The rotary drill bit includes a main body that encapsulates a cavity, from which several radially extending ribs project outward, providing the bit with its cutting edges. Each radially extending rib accommodates an internal manifold. These manifolds are strategically located inside the ribs, enabling not only the uniform distribution and disposal of drilling fluid but also contributing to the structural integrity of the drill bit. Placing the manifolds within the ribs provides an effective protective shield from external elements and drilling obstacles, thereby extending the bit's lifespan. Further, it also optimizes the amount of drilling fluid reaching the drill's cutting surface, evidently resulting in improved operational performance.

The congruent pairing of the manifold and the radial rib enhances the effectiveness and longevity of the drilling operation. The integration allows for better pressure management and fluid distribution which is crucial in mitigating extreme conditions such as heat and cavitation. In addition, the innovative design allows for easy access and eventual replacement of the manifold if required. The fine tuning of such parameters provides a hereto unparalleled level of control and precision in drilling operations. Thus, this invention amalgamates functionality, durability and efficiency into a single, robust structure, thereby facilitating advanced drilling dynamics.

The drill bit also features a multiple flow lines extent from the bit body's existing flow path. The uniqueness of design lies in each flow line extending to a respective one rib's manifold before connecting to a plurality of nozzles from this specific rib's manifold. This configuration provides a more efficient distribution of a drilling fluid throughout the drill bit and aids in cooling down drill bit components for optimal operational performance and longevity.

The main component of the rotary drill bit, the bit body, contains an internal flow path. This flow path allows for the passage of drilling fluid. Flow lines are strategically integrated into the bit body's flow path and they extend out towards the ribs of the bit. Each rib possesses a singular attributable manifold. This manifold acts as an intermediate channel, permitting the passage of drilling fluid from the flow line into the respective rib. The distinctive feature of this arrangement is the ability of each manifold to directly further distribute the drilling fluid to multiple nozzles.

The design provides a dual-purpose function which not only effectively carries out the drilling operation but also improves the life-span of the tool by cooling down the components. This design not only improves the operational performance by swiftly and evenly distributing the drilling fluid but also enhances the drill bit's longevity by reducing heat associated wear and tear. The drilling fluid flow is improved immensely as it travels from the main flow path in the bit body, via multiple flow lines, through the rib's manifold, finally expelling from the design's multiple nozzles. Through the implementation of this innovative design, the rotary drill bit vastly enhances the efficiency and effectiveness of the drilling operation while minimizing risk of overstress and overheating of the bit components.

The bit body having a face at one end, a shank at the opposite end, and an internal fluid passage connecting a fluid supply at the shank end with a plurality of nozzles mounted in the bit face; several cutting elements, each having a primary cutting surface; a nozzle discharge port in each nozzle; and each nozzle is designed in such a way that a center line of fluid jet flowing from each nozzle is within 5° of a line passing through a central axis of the nozzle discharge port and a primary cutting surface on a respective cutting element.

In regular drilling applications, having an efficient cooling and material removal process can significantly enhance the drill bit lifespan and performance. The spatial orientation and design of the nozzles on the invention play a key role in that efficiency. The unique strategic alignment of the nozzle ensures that the optimum flow of the jet fluid is directed towards the primary cutting surfaces on the cutting elements, providing enhanced cooling and removal of drilling cuttings from the bit face. This ideal positioning reduces wear and tear on cutting elements, particularly during high-demand drilling operations, increasing overall drilling efficiency and reducing costs.

Further, this innovative design also reduces the potential for clogging in the cutting elements as the precise angular positioning optimizes the fluid flow, creating a cleaner and more efficient drilling operation. This enhancement subsequently decreases the requirement for frequent maintenance higher, leading to more uninterrupted drilling operation time for a reduced overall cycle time in various drilling applications. With the potential to improve drilling efficiency dramatically, this rotary drill bit design offers an impressive advancement in drilling technology. The consistency of the cooling, lubricating, and cleaning features offered by this high precision engineering solution brings about substantial improvements in the operational performance and reliability of drilling systems.

One embodiment provides a conical profile of these nozzles, each possessing a mean intake located in the rib's manifold with a diameter ranging from 10 to 5 mm, and a discharge diameter spanning from 7 to 3 mm. This configuration allows for the controlled flow of drilling fluids, facilitating the removal of cuttings from the drilling surface, ultimately improving the drilling process efficiency and reliability. The conical profile of the nozzles in the rotary drill bit assists in increasing the velocity of the fluid as it travels through the narrower discharge end with diameters from 7 to 3 mm. Notably, the diameters of the nozzles are directly proportional to the speed and volume of the drilling fluid, thus affecting the hydraulic performance and cleaning efficiency of the drill bit. The design, location and form of the nozzles play a significant role in minimizing the formation of cuttings bed in the wellbore, further enhancing the drilling process by maintaining the bit's cleanliness and reducing wear. The embodiment also covers the mean intake of the nozzles, located in the rib's manifold with diameter range from 10 to 5 mm. The manifold serves as a conduit for directing drilling fluid to the nozzles. The varied diameter range of the intake facilitates regulation of the fluid flow to suit the specific drilling conditions. This particular feature has been conceived to ensure optimal operations irrespective of the drilling environment's complexity, thereby significantly enhancing the drilling bit's utility and overall functionality.

A method of drilling a hole in a subsurface formation is disclosed for the new drill bit. This process incorporates a bit body equipped with numerous radially extending ribs. Between each adjacent pair of ribs, there's a flow channel. Further along, the bit body includes a flow path that is located radially inward of its outer edges. This design allows for effective and efficient fluid flow, which is essential for successful drilling operations.

The method revolves around fixedly mounting multiple cutting elements on an individual rib from the extensive array of radially extending ribs. These cutting elements are instrumental in breaking down the subsurface formations during the drilling process. Their strategic placement on the ribs facilitates optimum drilling and provides superior control over the operation.

The rib's manifold provides the function of receiving the fluid flow from the bit body flow path, which it then channels through numerous conical profile's flow nozzles. Each of these nozzles serves a unique cutting element mounted on the subsequent neighboring rib. The fluid, thus, aids the cutting elements in their operation and expedites the drilling process. The strategic location of the manifold on the backside of the ribs ensures it is perfectly aligned with the cutters on the emanating rib. This arrangement promotes the smooth flow of fluid, hence enhancing the overall drilling process. A plurality of flow nozzles are in fluid communication with the bit body flow path. These nozzles are vital as they direct the fluid to the rib's manifold. Eventually, the fluid is transferred to a specific cutting element.

A manifold is provided for each of the plurality of radially extending ribs. The plurality of radially extending ribs are evenly spaced along the circumference of a cylinder or a reactor vessel. The interconnection of ribs and manifolds provides a structured rigidity and aids the distribution of fluids (gases or liquids) or heat within the reactor vessel or the cylinder. The radially extending ribs can be of similar or dissimilar lengths, and can extend from a center point outward in a radial direction, or along a linear path on the surface of the reactor vessel or the cylinder, to distribute the fluids, heat or pressure in all radial directions.

The manifold is placed across or along the running length of each rib as a channel or a distribution medium. The manifold can be an open or a closed system of conduits, pipes or channels and can be made from materials that are heat resistant, chemically inert, or pressure resistant. The manifold carries and distributes fluids or heat from one point of the rib to all other points of the rib. The design of the manifold can vary based on the applications, the amount of fluid or heat to be carried, and the type and extent of distribution required. Indeed, the manifold may be segmented into multiple zones or sections, each with its own inlet and outlet system, for the directed control and distribution of fluids, heat or pressure.

By applying this method, it is possible to achieve a uniform distribution of fluids, heat, or pressure across the entire radial length of the rib. This is particularly beneficial in applications where even distribution across the entirety of the reactor vessel or cylinder is critical, such as in application in chemical or nuclear reacting systems, heat exchangers, pressure vessels, and other similar scenarios. The method increases the efficiency of these applications by allowing a better heat transfer or matter exchange between the ribs and the internal environment of the vessel or the cylinder. Moreover, the manifolded rib can reduce the mechanical stress on the reactor vessel or the cylinder by evenly distributing the heat or pressure, thus increasing the lifespan and reliability of the system.

The method also involves the positioning and alignment of the fluid flow centerline within the specified angle. This positioning facilitates a more concentrated and focused output of high-pressure fluid towards the respective cutting element, resulting in a more efficient cutting operation with minimal resource wastage. The line that is formed passing through the central axis of the nozzle discharge port and the primary cutting surface edge heralds an innovative, direct and unobstructed pathway for the high-pressure fluid. This meticulous alignment furthermore mitigates the conventional challenges posed by uneven wear and tear as well as sub-optimal fluid delivery to the cutting element.

The above system can deliver the high-pressure fluid in a streamlined trajectory ensures that the most optimal force is administered directly onto the cutting surface, thus augmenting the effectiveness and efficiency of the cutting process. In addition, this method paves the way for more sustainable operations by reducing fluid wastage and extending the lifespan of both the nozzles and the cutting elements. The innovatively orchestrated positioning and alignment system underlines the significance and potential of this invention in revolutionizing cutting processes in a multitude of industrial applications. This increase in torque is accomplished by the strategic use of multiple hydrojets of drilling fluid, commonly known as mud. These hydrojets are instrumental in providing tangential momentum to the drill bit, thereby enhancing its operational efficiency. The hydrojets function on the principle of fluid mechanics, whereby the high-pressure drilling fluid is directed in a manner such that it generates a tangential force, effectively increasing the torque on the drill bit.

According to the devised method, the nozzles are judiciously located on the opposite side of the cutters, on the ribs of the drill bit. This location fulfills dual roles. First, it allows for the effective dispersion of drilling fluids at maximum pressurized force, accentuating the cutting efficiency of the drill bit. Second, it helps in maintaining the stability of the drill bit, thereby reducing the possibilities of it veering off course during drilling operations. This positioning of the nozzles demonstrates an improved understanding of mechanical engineering principles and offers an innovative solution to augment drilling efficiency. The relative distance between the rotation center of the drill bit and the location of the hydrojet nozzles plays a critical role in torque enhancement, following the principles of torque calculation in physics. By placing the nozzles at a calculated radial distance from the drill bit's rotational center, a lever mechanism is created. This lever effect further amplifies the tangential force exerted by the hydrojets, intensifying the resultant torque on the drill bit. This invention effectively integrates the principles of fluid dynamics, mechanics, and physics to bring an advancement in drilling technologies.

This invention adjusts the common drilling practice by harnessing the hydro-motor capabilities of the drill bit. Typically, the drill bit and hole string are powered by the rig's engines, which consume significant amounts of power and produce notable environmental hazards such as air pollution and potentially oil spills. This invention significantly reduces these issues by presenting a method that utilizes the hydro-motor features within the drill bit itself. This transformative approach contributes to energy efficiency while also reducing environmental impact.

The main essence of this invention lies in the distinctive use of the drill bit's hydro-motor properties. Under standard conditions, the drill bit is connected to the hole string and both are rotated by the rig's engines. These engines are often bulky, require large amounts of fuel to operate, and can lead to significant environmental degradation. However, by employing the hydro-motor capabilities of the drill bit, this method transforms the present operating process, thereby both preserving resources and mitigating potential harmful effects on the environment. This method not only benefits the immediate drilling process, through reduced power consumption, but also contributes to broader sustainable practices in the drilling industry. If widely adopted, this innovative improvement could result in a substantial reduction in the drilling industry's carbon footprint. Furthermore, by decreasing reliance on large engine systems, the method also bears potential for reducing costs associated with engine maintenance, fuel consumption, and hazard control. By aligning technological feasibility with environmental responsibility, this invention embodies a significant advancement in drilling practices.

The system maintains an optimal working temperature of the drilling bit. The invention employs a novel technique to manage thermal loads by increasing the heat rejection from the head of the drill bit to the drilling mud by making the internal cooling channels in the drill bit head. The channels provide an efficient passage for heat dissipation that prolongs the life of the drill bit and enhances its performance, thus making the drilling process quicker and more cost-effective. The design of the drill bit head is a vital parameter in oil and gas drilling processes as it encounters extreme conditions, including exceedingly high temperatures and pressures. These conditions can degrade the bit faster, leading to costly replacements and reduced drilling pace. This system overcomes these challenges by incorporating specific cooling channels into the drill bit head. These channels are designed to facilitate efficient heat transfer from the drill bit head to the surrounding drilling mud. The cooling channels work in conjunction with the drilling mud to maintain the temperature of the drill bit head within a desired range, thus increasing the life and performance of the drill bit. The incorporation of the cooling channels into the drill bit head provides an innovative way of managing thermal loads during drilling processes. The strategy for increasing heat rejection from the bit head does not only help in preserving the cutting effectiveness of the bit but also contributes to the lowering of the overall temperature of the system, which has direct bearings on the rate of wear and tear of the other components of the drilling setup. This inventive method is of considerable significance for enhancing the operational efficiency and sustaining economic viability in oil and gas exploration and extraction processes.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiments shown and described is exemplary, and various other substitutions, alterations and modifications, including but not limited to those design alternatives specifically discussed herein, may be made in the practice of the invention without departing from its scope.

What is claimed is:

1. A rotary drill bit for drilling a hole in a subsurface formation, comprising:

a bit body having a leading cutting face and outer peripheral edges, the bit body including a plurality of radially extending ribs with a flow channel between each pair of adjacent ribs with each pair comprising a leading rib and a trailing rib relative to a direction of rotation of the rotary drill bit and each rib comprising a leading face and a trailing face, the bit body further including a bit body flow path radially inward of the peripheral edges and a manifold for receiving a fluid flow from the bit body flow path located inside of each rib;

a plurality of cutting elements each fixedly mounted on the leading face of a respective one of the plurality of radially extending ribs;

a plurality of conical flow nozzles on the trailing face on each rib's manifold in fluid communication with the bit body flow path to create and direct fluid jets from the manifold to a cutter's edge of a respective one of the plurality of cutting elements on the respective trailing rib to clean and cool the cutting element; and wherein the fluid flows tangentially to the circumference of bit body through the plurality of conical flow nozzles to the respective plurality of cutting elements mounted on a respective trailing rib and wherein the rib's manifold is positioned on the trailing face of a respective leading rib opposite cutters mounted on the leading face of the leading rib to create a torque in the same direction as applied to the drill bit, and wherein fins extend radially in-ward about a circumference of the bit body flow path, thereby forming cooling channels between fins.

2. The rotary drill bit of claim 1, wherein the nozzles are positioned on a respective rib's trailing face opposite side of the cutters at a radial distance from a rotation center of the drill bit to create a lever.

3. The rotary drill bit of claim 2, wherein the nozzles comprise converging profile to increase fluid mud flow.

4. The rotary drill bit of claim 1, wherein the each cutting element is mounted on a respective blade and includes face cutting elements for defining a leading cutting face substantially perpendicular to a bit centerline and side cutting elements adjacent the outer peripheral edges of the bit body.

5. The rotary drill bit of claim 1, further comprising a plurality of flow lines each extending from the bit body flow path to a respective one rib's manifold and then to the plurality of nozzles from this the rib's manifold.

6. The rotary drill bit of claim 1, wherein a center line of the fluid jet flowing from each nozzle is within 5° of a line passing through a central axis of the nozzle discharge port and the cutting surface on the respective trailing cutting element.

7. The rotary drill bit of claim 1, wherein each nozzle has the conical profile and a mean intake located in the rib's manifold.

8. A method of liquid extraction, comprising:

providing a drill bit having a bit body with a leading cutting face and outer peripheral edges, the bit body including a plurality of radially extending ribs with a flow channel between each pair of adjacent ribs with each pair comprising a leading rib and a trailing rib relative to a direction of rotation of the rotary drill bit and each rib comprising a leading face and a trailing face, the bit body further including a bit body flow path radially inward of the peripheral edges and a manifold for receiving a fluid flow from the bit body flow path located inside of each rib, the drill bit including a plurality of cutting elements each fixedly mounted on the leading face of a respective one of the plurality of radially extending ribs, and wherein fins extend radially in-ward about a circumference of the bit body flow path, thereby forming cooling channels between fins; and providing a plurality of flow nozzles, one nozzle for each cutting element, and each nozzle in fluid communication with the bit body flow path for directing fluid to the rib's manifold and then to the cutting elements; and drilling a hole to access a subsurface formation using the drill bit.

9. The method of claim 8, wherein the rib's manifold is provided for each of the plurality of radially extending ribs.

10. The method of claim 8, wherein a centerline of fluid flow from each nozzle is within 5° of a line passing through a central axis of the nozzle discharge port.

11. The method of claim 8, wherein the nozzles are at radial distance from the rotation center of the drill bit to create a lever.

12. The method of claim 11, wherein the flow nozzles create torque with a conical, converging nozzle profile.

13. The method of claim 8, comprising increasing the heat rejection from the drill bit with the cooling channels in fluid communication with the bit body flow path.

14. The method of claim 8, comprising providing wherein the cooling channels comprise with a rectangular profile with thin fins and a base between the fins.

15. The method of claim 14, wherein a ratio of a channel base size to a fin thickness is in the range from 3 to 7 and a ratio of the fin's height to the base is 2.

16. A drill bit, comprising:

a bit body having a leading cutting face and outer peripheral edges, the bit body including a plurality of radially extending ribs with a flow channel between each pair of adjacent ribs with each pair comprising a leading rib and a trailing rib relative to a direction of rotation of the rotary drill bit and each rib comprising a leading face and a trailing face, the bit body further including a bit body flow path radially inward of the peripheral edges and a manifold for receiving a fluid flow from the bit body flow path located inside of each rib;

a plurality of cutting elements each fixedly mounted on the leading face of a respective one of the plurality of radially extending ribs;

a plurality of conical flow nozzles on the trailing face on each rib's manifold in fluid communication with the bit body flow path to create and direct fluid jets from the manifold to a cutter's edge of a respective one of the plurality of cutting elements on the respective trailing rib to clean and cool the cutting element, wherein the fluid flows tangentially to the circumference of bit body through the plurality of conical flow nozzles to the respective plurality of cutting elements mounted on a respective trailing rib and wherein the rib's manifold is positioned on the trailing face of a respective leading rib opposite cutters mounted on the leading face of the leading rib to create torque in the same direction as applied to the drill bit; and cooling channels with fins on a base between the fins, wherein a ratio of a channel base size to a fin thickness is in the range from 3 to 7 and a ratio of the fin's height to the base is 2.

* * * * *